United States Patent [19]

Bradbury et al.

[11] Patent Number: 4,977,135

[45] Date of Patent: Dec. 11, 1990

[54] THERMAL TRANSFER PRINTING

[75] Inventors: Roy Bradbury, Cheshire; Peter A. Gemmell, Ipswich; Richard A. Hann, Cheshire, all of England

[73] Assignee: Imperial Chemical Industries PLC, London, England

[21] Appl. No.: 380,127

[22] Filed: Jul. 14, 1989

[30] Foreign Application Priority Data

Jul. 20, 1988 [GB] United Kingdom ..... 8817219

[51] Int. Cl.[5] ..... B41M 5/035; B41M 5/26

[52] U.S. Cl. ..... 503/227; 8/471; 428/195; 428/480; 428/913; 428/914

[58] Field of Search ..... 8/471; 428/195, 480, 428/913, 914; 503/227

[56] References Cited

U.S. PATENT DOCUMENTS 4,725,284 2/1988 Black et al. ..... 503/227

FOREIGN PATENT DOCUMENTS 0172591 9/1985 Japan ..... 503/227

*Primary Examiner*—Bruce H. Hess

*Attorney, Agent, or Firm*—Cushman, Darby & Cushman

[57] ABSTRACT

A thermal transfer printing sheet suitable for use in a thermal transfer printing process, comprising a substrate having a coating comprising a binder and an anthraquinone of the Formula I:

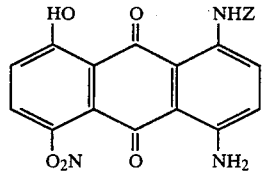

or a mixture of an anthraquinone dye of the Formula I and a disazo dye of Formula II:

$$A-N=N-B-N=N-E \qquad \text{II}$$

wherein:

Z is hydrogen or an optionally substituted aliphatic or an optionally substituted aryl radical;

A is the residue of a diazotizable phenylamino or naphthylamine, A-$NH_2$, carrying no more than one unsaturated electron-withdrawing group;

B is an optionally substituted thiophen-2,5-ylene or thiazol-2,5-xylene; and

E is the residue of an aromatic coupling component E-X wherein X is an atom or group displaceable by a diazotized aromatic amine.

19 Claims, No Drawings

THERMAL TRANSFER PRINTING

INTRODUCTION

This invention relates to dye diffusion thermal transfer printing (DDTTP), especially to a DDTTP sheet carrying a dye or dye mixture, to the transfer printing process, to the dye and dye mixture and to the preparation of the DDTTP sheet.

In DDTTP, a heat-transferable dye is applied to a sheet-like substrate in the form of an ink, usually containing a polymeric or resinous binder to bind the dye to the substrate, to form a transfer sheet. This is then placed in contact with the material to be printed, (generally a film of polymeric material such as a polyester sheet) hereinafter called the receiver sheet and selectively heated in accordance with a pattern information signal whereby dye from the selectively heated regions of the transfer sheet is transferred to the receiver sheet and forms a pattern thereon in accordance with the pattern of heat applied to the transfer sheet.

Important criteria in the selection of a dye for DDTTP are its thermal properties, brightness of shade, fastness properties, such as light fastness, and facility for application to the substrate in the preparation of the transfer sheet. For suitable performance the dye should transfer evenly, in proportion to the heat applied to the DDTTP sheet so that the depth of shade on the receiver sheet is proportional to the heat applied and a true grey scale of coloration can be achieved on the receiver sheet. Brightness of shade is important in order to achieve as wide a range of shades with the three primary dye shades of yellow, magenta and cyan. As the dye must be sufficiently mobile to migrate from the transfer sheet to the receiver sheet at the temperatures employed, 300°–400° C., it is generally free from ionic and water-solubilising groups, and is thus not readily soluble in aqueous or water-miscible media, such as water and ethanol. Many suitable dyes are also not readily soluble in the solvents which are commonly used in, and thus acceptable to, the printing industry; for example, alcohols such as i-propanol, ketones such as methyl-ethylketone (MEK), methyl-i-butylketone (MIBK) and cyclohexanone, ethers such as tetrahydrofuran and aromatic hydrocarbons such as toluene. Although the dye can be applied as a dispersion in a suitable solvent, it has been found that brighter, glossier and smoother final prints can be achieved on the receiver sheet if the dye is applied to the substrate from a solution. In order to achieve the potential for a deep shade on the receiver sheet it is desirable that the dye should be readily soluble in the ink medium. It is also important that a dye which has been applied to a transfer sheet from a solution should be resistant to crystallisation so that it remains as an amorphous layer on the transfer sheet for a considerable time.

The following combination of properties are highly desirable for a dye which is to be used in DDTTP:

- Ideal spectral characteristics (narrow absorption curve with absorption maximum matching a photographic filter).
- High tinctorial strength.
- Correct thermochemical properties (high thermal stability and good transferability with heat).
- High optical densities on printing.

- Good solubility in solvents acceptable to printing industry: this is desirable to produce solution coated dyesheets.
- Stable dyesheets (resistant to dye migration or crystallisation).
- Stable printed images on the receiver sheet (to heat, migration, crystallisation, grease, rubbing and light).

The achievement of good light fastness in DDTTP is extremely difficult because of the unfavourable environment of the dye, namely surface printed polyester on a white pigmented base. Many known dyes for polyester fibre with high light fastness (>6 on the International Scale of 1–8) on polyester fibre exhibit very poor light fastness (<3) in DDTTP.

It has now been found that certain anthraquinone dyes provide useful cyan shades having high light fastness and that the anthraquinone dyes can be used in admixture with certain cyan disazo dyes to provide prints having high light fastness, high optical density and excellent stability, particularly with respect to grease resistance.

THE INVENTION

According to a first aspect of the invention, there is provided a thermal transfer printing sheet comprising a substrate having a coating comprising a binder and an anthraquinone dye of the Formula I:

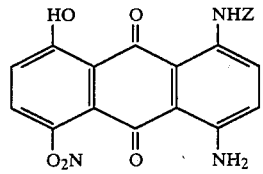

(I)

wherein Z represents hydrogen or an optionally substituted aliphatic or optionally substituted aryl radical.

According to a second aspect of the invention, there is provided a thermal transfer sheet comprising a substrate having a coating comprising a mixture of an anthraquinone dye of Formula I and a disazo dye of the Formula II:

$$A-N=N-B-N=N-E \quad \text{(II)}$$

wherein:

- A is the residue of a diazotisable phenylamine or naphthylamine, A-$NH_2$, carrying not more than one unsaturated electron-withdrawing group;
- B is an optionally substituted thiophen-2,5-ylene or thiazol-2,5-ylene group; and
- E is the residue of an aromatic coupling component E-X wherein X is an atom or group displaceable by a diazotised aromatic amine.

THE COATING

The coating preferably comprises a binder and one or more dyes of Formula I or a combination of one or more dyes of Formula I together with one or more dyes of Formula II. The ratio of binder to dye is preferably at least 1:1 and more preferably from 1.5:1 to 4:1 in order to provide good adhesion between the dye and the substrate and inhibit migration of the dye during storage.

The coating may also contain other additives, such as curing agents, preservatives, etc., these and other ingredients being described more fully in EP No. 133011A, EP No. 133012A and EP No. 111004A.

THE BINDER

The binder may be any resinous or polymeric material suitable for binding the dye to the substrate which has acceptable solubility in the ink medium, i.e. the medium in which the dye and binder are applied to the transfer sheet. Examples of binders include cellulose derivatives, such as ethylhydroxyethylcellulose (EHEC), hydroxypropylcellulose (HPC), ethylcellulose, methyl- cellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicons, such as polysiloxanes, epoxy resins and natural resins, such as gum tragacanth and gum arabic. Mixtures of two or more of the above may be used.

It is however preferred to use a binder which is soluble in one of the above-mentioned commercially acceptable organic solvents. Preferred binders of this type are EHEC and ethyl cellulose.

THE DYES AND DYE MIXTURES

In the anthraquinone dyes of Formula I Z represents optionally substituted alkyl radicals, optionally substituted cycloalkyl radicals or optionally substituted aryl radicals. It is preferred that Z represents optionally substituted $C_{1-8}$-alkyl, especially optionally substituted $C_{1-4}$-alkyl; optionally substituted $C_{4-8}$-cycloalkyl or optionally substituted phenyl.

Specific examples of suitable alkyl radicals include: methyl, ethyl, n-propyl, iso-propyl, n-butyl, iso-butyl, sec-butyl, tert-butyl, n-pentyl, n-hexyl and 1,5-dimethylhexyl.

Preferred substituents for the alkyl radicals are: $C_{1-4}$-alkoxy- such as 2-methoxyethyl, 2-ethoxyethyl, 3-methoxypropyl, 3-ethoxypropyl and 3-propoxypropyl; $C_{1-4}$-alkylcarbonyloxy such as acetoxyethyl; cyano- such as 2-cyanoethyl; $C_{1-4}$-alkoxycarbonyl such as 2-ethoxycarbonylethyl; and phenyl such as benzyl and 2-phenylethyl.

Specific examples of suitable cycloalkyl radicals includes cyclohexyl.

Preferred substituents for the cycloalkyl radicals include: $C_{1-4}$-alkyl such as 2-methylcyclohexyl; $C_{1-4}$-alkoxy such as 2-, 3- or 4-methoxycyclohexyl and 2-, 3- or 4-ethoxycyclohexyl; and phenyl-$C_{1-4}$-alkyl such as 2-(benzyl)cyclohexyl.

Specific examples of suitable aryl radicals includes phenyl.

Preferred substituents for the aryl radicals include: halogen such as chlorophenyl or bromophenyl; $C_{1-4}$-alkyl such as 2-, 3- or 4-methylphenyl; $C_{1-4}$-alkoxy such as methoxy and ethoxyphenyl; $C_{1-4}$-alkylcarbonylamino such as acetylaminophenyl; $C_{1-4}$-alkylcarboxy such as acetoxyphenyl; N-$C_{1-4}$-alkylamino such as N-ethylaminophenyl; and N,N-di($C_{1-4}$-alkyl)amino such as N,N-diethylaminophenyl.

Methods for the preparation of dyes of Formula I have been described in our United Kingdom Patent Specification No.1284932 where it is explained that, depending upon the preparative conditions, the dyes of Formula I may be obtained in substantially pure form or as mixtures with dyes of the formulae:

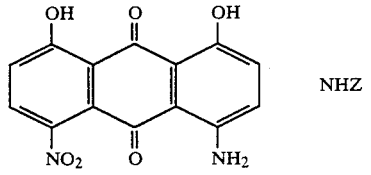

(III)

and/or

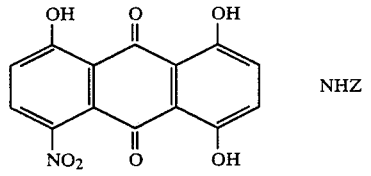

(IV)

In the thermal transfer printing sheets of the present invention, the dyes of Formula I are preferably present in pure form but may be present as mixtures with dyes of Formula III and/or Formula IV.

In the disazo dyes of Formula II, the residue, A, of the amine, A-$NH_2$, is preferably a phenyl group which may be unsubstituted or substituted by non-ionic groups, preferably those which are free from acidic hydrogen atoms unless these are positioned so that they form intramolecular hydrogen bonds. By the term unsaturated electron-withdrawing group is meant a group of at least two atoms containing at least one multiple (double or triple) bond and in which at least one of the atoms is more electronegative than carbon. Examples of preferred unsaturated electron-withdrawing groups are —CN; —SCN; —$NO_2$; —$CONT_2$; —$SO_2NT_2$; —COT; —$SO_2T^1$; —$COOT^2$; —$SO_2OT^2$; —COF; —COCl; —$SO_2F$ and —$SO_2Cl$, wherein each T is independently H, $C_{1-4}$-alkyl or phenyl, $T^1$ is $C_{1-4}$-alkyl or phenyl and $T^2$ is $C_{1-4}$-alkyl.

Examples of other suitable substituents which may be carried by A in place of, or in addition to, the unsaturated electron-withdrawing group are $C_{1-4}$-alkyl; $C_{1-4}$-alkoxy; $C_{1-4}$-alkoxy-$C_{1-4}$-alkyl; $C_{1-4}$-alkoxy-$C_{1-4}$-alkoxy; —$NT_2$; halogen, especially Cl, Br and F; $CF_3$; cyano-$C_{1-4}$-alkyl and $C_{1-4}$-alkylthio.

It is preferred that A is of the formula:

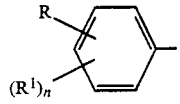

V wherein:

R is selected from —H; —CN; —SCN; —$NO_2$; —$CONT_2$; —$SO_2NT_2$; —COT; —$SO_2T^1$; —$COOT^2$; —$SO_2OT^2$; —COF; —COCl; —$SO_2F$; —$SO_2Cl$; in which each T is independently H, $C_{1-4}$-alkyl or phenyl, $T^1$ is $C_{1-4}$-alkyl or phenyl and $T^2$ is $C_{1-4}$-alkyl;

each $R^1$ is independently selected from H; $C_{1-4}$-alkyl; $C_{1-4}$-alkoxy; —F; —Cl; —Br; —$CF_3$ and —$NT_2$, in which T is as described above;

and n is 1, 2 or 3.

Examples of phenyl and naphthyl groups represented by A are phenyl, 2-chlorophenyl, 4-chlorophenyl, 2,4-dichlorophenyl, 2-trifluoromethyl-4-chlorophenyl, 3,4-dichlorophenyl, 2-bromophenyl, 2-nitrophenyl, 4-nitrophenyl, 2-cyanophenyl, 3-cyanophenyl, 4-cyanophenyl, 2-trifluoromethylphenyl, 4-(methoxycarbonyl)phenyl, 4-(ethoxycarbonyl)phenyl, 4-methylphenyl, 3-methylphenyl, 4-(methylsulphonyl)phenyl, 4-thiocyanophenyl, 2-chloro-4-nitrophenyl and 1-naphthyl.

The optionally substituted thiophen-2,5-ylene or thiazol-2,5-yl group, B, is preferably derived from a 2-aminothiophene or 2-aminothiazole having a hydrogen atom or a group displaceable by a diazotised amine in the 5-position and optionally other non-ionic substituents present in the 3 and/or 4 positions. Examples of suitable substituents for the 3 and 4 positions are those given above for A. It is preferred that the 4-position is unsubstituted or is substituted by a group selected from $C_{1-4}$-alkyl; $C_{1-4}$-alkoxy; aryl, especially phenyl and $NO_2$-phenyl; $C_{1-4}$-alkoxy-CO; $C_{1-4}$alkoxy-$C_{1-4}$-alkoxy-CO— and halogen. Especially preferred substituents for the 3-position of the thiophen-2,5-ylene group are —CN; —$NO_2$; —$CONT_2$; —$SO_2NT_2$; —$COT^1$ and —$SO_2T^1$ and those given above for the 4-position, in which T and $T^1$ are as described above.

It is preferred that B is a group of the formula:

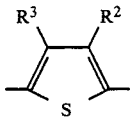

VI wherein $R^2$ is selected from CN, —$COOT^1$, —$COT^1$ and —$CONT_2$; and $R^3$ is H or $C_{1-4}$-alkyl, in which T and $T^1$ are as described above.

It is especially preferred that $R^2$ is —CN; acetyl; methoxycarbonyl; ethoxycarbonyl or dimethylaminocarbonyl and $R^3$ is H or methyl.

Examples of suitable 2-aminothiophenes and 2-aminothiazoles are:

2-amino-3-cyanothiophene
2-amino-3-cyano-4-methylthiophene
2-amino-3-acetylthiophene
2-amino-3-(ethoxycarbonyl)thiophene
2-amino-3-(aminocarbonyl)thiophene
2-amino-3-(dimethylaminocarbonyl)thiophene 2-aminothiazole
2-amino-4-methylthiazole The coupling component is preferably of the formula, E-H, in which X is a displaceable hydrogen atom. It is further preferred that the coupling component is an optionally substituted aniline, naphthylamine, diaminopyridine, aminoheteroaromatic, such as tetrahydroquinoline and julolidine, or hydroxypyridone. Especially preferred coupling components are optionally substituted anilines and tetrahydroquinolines. Examples of suitable substituents for the rings of these systems are $C_{1-4}$-alkyl; $C_{1-4}$-alkoxy; $C_{1-4}$-alkyl- and phenyl—N-H—CO—; $C_{1-4}$alkyl- and phenyl—CO—NH—; halogen, especially —Cl and —Br; $C_{1-4}$-alkyl-CO—O—$C_{1-4}$alkyl; $C_{1-4}$-alkoxy-$C_{1-4}$-alkyl and cyano-$C_{1-4}$-alkyl. It is preferred that E is a 4-aminophenyl group preferably having one or two optionally substituted $C_{1-4}$-alkyl groups attached to the amino group and optionally carrying one ring substituent in the 3-position or two ring substituents in the 2 and 5 positions with respect to the amino group. Preferred ring substituents are $C_{1-4}$-alkyl, especially methyl; cyano-$C_{1-4}$-alkyl esp. 2-cyanoethyl, $C_{1-4}$-alkoxy, especially methoxy or ethoxy and $C_{1-4}$-alkyl—CONH—, especially acetylamino. Preferred substituents for the amino group are independently selected from $C_{1-4}$-alkyl, especially ethyl and/or butyl; aryl, especially phenyl; $C_{4-8}$-cycloalkyl; and $C_{1-4}$-alkyl substituted by a group selected from —OH; —CN; halogen, especially —F, —Cl or —Br; aryl, especially phenyl; $C_{1-4}$-alkoxy-$C_{1-4}$-alkoxy; $C_{1-4}$-alkoxy, $C_{1-4}$-alkyl-CO—, $C_{1-4}$-alkoxy-CO—, $C_{1-4}$-alkyl-COO—, $C_{1-4}$-alkoxy-O—$C_{1-4}$-alkoxy-CO—, $C_{1-4}$-alkoxy-COO—, $C_{1-4}$-alkyl-NHCOW wherein W is $C_{1-4}$-alkyl or optionally substituted phenyl and $C_{1-4}$-alkyl$CONZ^1Z^2$ wherein each of $Z^1$ and $Z^2$, independently, is H, $C_{1-4}$-alkyl or optionally substituted phenyl provided that at least one of $Z^1$ and $Z^2$ is not H.

It is especially preferred that E is a group of the formula:

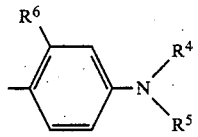

VII wherein $R^4$ and $R^5$ are independently selected from —H; $C_{1-4}$-alkyl; phenyl; $C_{4-8}$-cycloalkyl and $C_{1-4}$-alkyl substituted by a group selected from —OH, —CN, halogen, phenyl, $C_{1-4}$-alkoxy, $C_{1-4}$-alkoxy-$C_{1-4}$-alkoxy, $C_{1-4}$-alkyl-CO—, $C_{1-4}$-alkoxy-CO—, $C_{1-4}$-alkyl-COO—, $C_{1-4}$-alkoxy-$C_{1-4}$-alkoxy-CO—, $C_{1-4}$-alkoxy-COO—; and phenyl optionally carrying a substituent selected from R and $R^1$ above; and $R^6$ is selected from H; $C_{1-4}$-alkyl; cyano $C_{1-4}$-alkyl; $C_{1-4}$-alkoxy and —$NHCOT^1$ in which $T^1$ is as described above.

The aryl group represented by, or contained in, $R^4$ and/or $R^5$ is preferably phenyl or substituted phenyl, examples of suitable substituents being those given above for A.

It is preferred that $R^4$ and $R^5$ are $C_{2-4}$-alkyl which may be the same or different and, more especially, that $R^4$ is ethyl and $R^5$ is n-propyl or n-butyl, or that $R^4$ and $R^5$ are both ethyl or both n-propyl or both n-butyl. It is also preferred that $R^6$ is H, methyl or, more especially, acetylamino.

Examples of coupling components represented by E-H are:

N,N-diethylaniline
N-n-butyl-N-ethylaniline
3-methyl-N,N-diethylaniline
3-methyl-N,N-di(2-acetoxyethyl)aniline
3-methyl-N-ethyl-N-benzylaniline
3-methyl-N-n-butyl-N-2-(ethoxycarbonyl)ethylaniline
3-methyl-N-n-butyl-N-[3-(ethoxycarbonyl)propyl]aniline
3-methyl-N,N-di(n-propyl)aniline
3-methyl-N-n-butyl-N-ethylaniline
3-methoxy-N,N-diethylaniline
3-methoxy-N,N-di(2-[ethoxycarbonyl]ethyl)aniline
3-acetylamino-N,N-diethylaniline
3-acetylamino-N,N-di(n-butyl)aniline
3-acetylamino-N-ethyl-N-(n-butyl)aniline
3-(2-cyanoethyl-N,N-diethylaniline
N,N-di(2-acetoxyethyl)aniline
N,N-di(2-cyanoethyl)aniline
N-ethyl-N-cyanoethylaniline.

A preferred sub-class of disazo dyes which may be used according to the present invention conform to the formula:

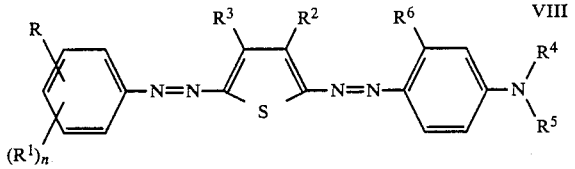

VIII wherein

R is selected from —H; —CN; $—NO_2$; $—CONT_2$—; $—SO_2NT_2$; —COT; $—SO_2T^1$; $—COOT^2$ and $—SO_2OT^2$;

each $R^1$ is independently selected from —H; halogen, especially —F, —Cl or —Br; $—CF_3$; $C_{1-4}$-alkyl; $C_{1-4}$-alkoxy; $—NT_2$;

n is 1, 2 or 3;

$R^2$ is selected from —CN, $—COT^1$, $—CONT_2$ and $—COOT^1$;

$R^3$ is —H or $C_{1-4}$-alkyl;

$R^4$ & $R^5$ are independently selected from —H, $C_{1-4}$-alkyl, phenyl, $C_{4-8}$-cycloalkyl and $C_{1-4}$-alkyl substituted by a group selected from —OH, —CN, $C_{1-4}$-alkoxy, $C_{1-4}$-alkoxy-$C_{1-4}$-alkoxy, $C_{1-4}$-alkyl-CO—, $C_{1-4}$-alkoxy-CO—, $C_{1-4}$-alkyl-COO—, halogen, $C_{1-4}$-alkoxy-$C_{1-4}$-alkoxy-CO—, $C_{1-4}$-alkoxy-COO— and phenyl;

and $R^6$ is selected from H, $C_{1-4}$-alkyl, cyano $C_{1-4}$-alkyl, $C_{1-4}$-alkoxy and $—NHCOT^1$;

wherein T, $T^1$ and $T^2$ are as described above.

When there are two substituents selected from R and $R^1$ these are preferably in the 2- and 4- or 3- and 4-positions and where there are three substituents selected from R and $R^1$ these are preferably in the 2-, 4- and 6-positions.

In an especially preferred class of dye within Formula VIII, R is selected from —H; —CN; $C_{1-4}$-alkyl-$SO_2$— and $C_{1-4}$-alkoxy-CO—; $R^1$ is selected from —H; —Cl; —Br; $—CF_3$; $C_{1-4}$-alkyl; $R^2$ is —CN or $—CON(CH_3)_2$; $R^3$ is —H or $—CH_3$; $R^6$ is —H; $—CH_3$ or $C_{1-4}$-alkyl-CONH—; and n=1.

Another preferred class of dye within Formula VIII is that in which R and $R^3$ are —H, n is 2 and each $R^1$ is independently selected from H; halogen, especially —F, —Cl, or —Br; $C_{1-4}$-alkyl; $C_{1-4}$-alkoxy and $—CF_3$.

A further preferred sub-class of disazo dyes which may be used according to the present invention conform to the formula:

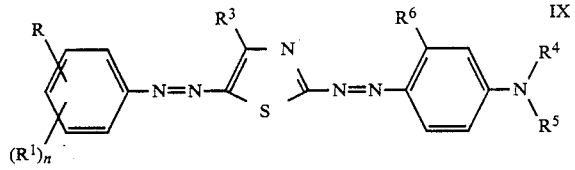

IX wherein

R is selected from H; —CN; $—NO_2$; $—CONT_2$; $—SO_2NT_2$; —COT; $—SO_2T^1$; $—COOT^2$ and $—SO_2OT^2$;

$R^1$ is selected from —H; halogen; $—CF_3$; $C_{1-4}$-alkyl; $C_{1-4}$-alkoxy; $—NT_2$;

n is 1, 2 or 3;

$R^3$ is —H or $C_{1-4}$-alkyl;

$R^4$ and $R^5$ are independently selected from —H; $C_{1-4}$-alkyl; phenyl; $C_{4-8}$-cycloalkyl and $C_{1-4}$-alkyl substituted by a group selected from OH, CN, $C_{1-4}$-alkoxy, $C_{1-4}$-alkoxy-$C_{1-4}$-alkoxy, $C_{1-4}$-alkyl-CO—, $C_{1-4}$-alkoxy-CO—, $C_{1-4}$-alkyl-COO—, halogen, $C_{1-4}$-alkoxy-$C_{1-4}$-alkoxy-CO—, $C_{1-4}$-alkoxy-COO—0 and phenyl;

and $R^6$ is selected from —H; $C_{1-4}$-alkyl; cyano $C_{1-4}$-alkyl; $C_{1-4}$-alkoxy and $—NHCOT^1$;

wherein T, $T^1$ and $T^2$ are as described above.

Preferred dyes of Formula IX are those in which R and $R^1$ are —H, $R^3$ is —H or methyl, $R^4$and $R^5$ are selected from ethyl, n-propyl or n-butyl and $R^6$ is —H, methyl or acetylamino; and n=1.

Especially useful combinations of dyes for use in accordance with the invention can be formed from a dye of Formula I wherein Z is sec-butyl or 4-methylphenyl and a dye of Formula VIII wherein each of R, $R^1$ and $R^3$ is hydrogen, $R^2$ is cyano, each of $R^4$ and $R^5$ is ethyl or ethoxyethyl and $R^6$ is acetylamino or hydrogen.

The dyes of Formula I and Formula II have particularly good thermal properties giving rise to even prints on the receiver sheet, whose depth of shade is accurately proportional to the quantity of applied heat so that a true grey scale of coloration can be attained.

Mixtures of dyes of Formula I and Formula II give prints with unexpectedly high resistance to grease and higher than expected OD when compared with prints produced with the individual dyes.

The dyes of Formula I and Formula II also have strong coloristic properties and good solubility in a wide range of solvents, especially those solvents which are widely used and accepted in the printing industry, for example, alkanols, such as i-propan-ol & butanol; aromatic hydrocarbons, such as toluene, ketones such as MEK, MIBK and cyclohexanone and ethers such as tetrahydrofuran (THF). This produces inks (solvent plus dye and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The receiver sheets according to the present invention have bright, strong and even cyan shades which are fast to both light and heat.

THE SUBSTRATE

The substrate may be any convenient sheet material capable of withstanding the temperatures involved in DDTTP, up to 400° C. over a period of up to 20 milliseconds (msec) yet thin enough to transmit heat applied on one side through to the dye on the other side to effect transfer to a receiver sheet within such short periods, typically from 1–10 msec. Examples of suitable materials are paper, especially high quality paper of even thickness, such as capacitor paper, heat resistant polymers such as polyester, polyacrylate, polyamide, cellulosic and polyalkylene films, metallised forms thereof, including co-polymer and laminated films, especially laminates incorporating a polyester receptor layer on which the dye is deposited. Such laminates preferably comprise, a backcoat, on the opposite side of the laminate from the receptor layer, of a heat resistant material, such as a thermoseting resin, e.g. a silicone, acrylate or polyurethane resin, to separate the heat source from the polyester and prevent melting of the latter during the thermal transfer printing operation. The thickness of the substrate may be varied to some extent depending upon its thermal characteristics but is preferably less that 20_m and more preferably below 10_m, especially from 2 to 6 μm.

PREPARATION OF TRANSFER SHEET

A transfer sheet may be prepared by applying a coating of the dye, dissolved or dispersed in suitable solvents and containing appropriate binders to form an ink, to the substrate such that a wet film of ink is produced on the surface of the substrate. The ink is then dried to produce the transfer sheet.

THE DDTTP PROCESS

According to a further feature of the present invention there is provided a transfer printing process which comprises contacting a transfer sheet coated with a dye of Formula I and optionally a dye of Formula II with a receiver sheet, so that the dye is in contact with the receiver sheet and selectively heating areas of the transfer sheet whereby dye in the heated areas of the transfer sheet may be selectively transferred to the receiver sheet.

The transfer sheet is preferably heated to a temperature from 250° C. to 400° C., more preferably above 300° C. and especially around 350° C., for a period of from 1 to 10 milliseconds while it is maintained with the coating in contact with the receiver sheet. The depth of shade of print on any area of the receiver sheet will vary with the time period for which the transfer sheet is heated while in contact with that area of the receiver sheet.

THE RECEIVER SHEET

The receiver sheet conveniently comprises a polyester sheet material, especially a white polyester film, preferably of polyethylene terephthalate (PET). Although some dyes of Formula I and Formula II are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye is applied, into which the dye more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the dyes of Formula I and Formula II give particularly strong and good quality prints (e.g. fast to light, heat and storage) on any specific transfer or receiver sheet, compared with other dyes of similar structure which have been proposed for thermal transfer printing. The design of receiver and transfer sheets is discussed further in EP No. 133,011 and EP No. 133012.

The invention is further illustrated by the following example in which all parts and percentages are by weight unless otherwise indicated.

Specific examples of suitable dyes of Formula I are shown in Table 1.

TABLE 1

| Dye | Z |
|---|---|
| 1 | $-CH_2CH_2CH_2OCH_3$ |
| 2 | $-CH_2CH_2CH_2OC_3H_7$ |
| 3 | 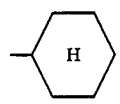 |
| 4 | 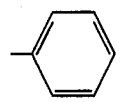 |
| 5 | 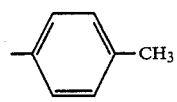 |
| 6 | 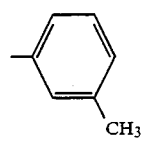 |
| 7 | 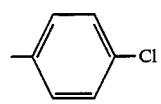 |
| 8 | 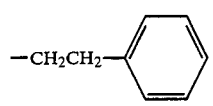 |
| 9 | 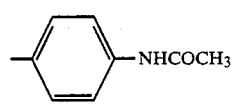 |
| 10 | 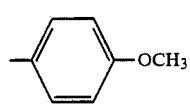 |
| 11 | $CH_3-\underset{\vert}{C}HC_2H_5$ |

Specific examples of suitable dyes of Formula VIII are shown in Table 2.

TABLE 2

| Dye | R | $R^1$ | $R^2$ | $R^3$ | $R^4$ | $R^5$ | $R^6$ |
|---|---|---|---|---|---|---|---|
| 12 | H | H | CN | H | $C_2H_5$ | $C_4H_9$ | $NHCOCH_3$ |
| 13 | H | H | CN | H | $C_2H_5$ | $C_2H_4OC_2H_5$ | H |
| 14 | H | H | CN | $CH_3$ | $C_2H_5$ | $C_2H_5$ | $NHCOCH_3$ |
| 15 | H | H | $CONMe_2$ | H | $C_2H_5$ | $C_2H_5$ | $NHCOCH_3$ |
| 16 | CN | H | CN | H | $C_2H_5$ | $C_2H_5$ | $NHCOCH_3$ |
| 17 | CN | $NO_2$ | CN | H | $C_2H_5$ | $C_2H_5$ | $NHCOCH_3$ |

TABLE 2-continued

| Dye | R | $R^1$ | $R^2$ | $R^3$ | $R^4$ | $R^5$ | $R^6$ |
|---|---|---|---|---|---|---|---|
| 18 | H | H | CN | H | $C_2H_5$ | $C_2H_5$ | $NHCOCH_3$ |

The invention is further illustrated by the following examples in which all parts and percentages are by weight.

Ink 1

This was prepared by dissolving 0.15 parts of Dye 1 in 5 parts of tetrahydrofuran (THF). 5 parts of a solution containing 6% of ethyl hydroxyethylcellulose-high viscosity (EHEC—H) were added and the mixture was stirred until homogeneous.

Inks 2–18

These were prepared by the same method as Ink 1.

Ink 19

This was prepared by dissolving 0.075 parts of Dye 11 and 0.075 parts of Dye 18 in 5 parts of THF and adding EHEC—H as for Ink 1.

Ink 20

This was prepared as Ink 19 but using 0.075 parts of Dye 5 and 0.075 parts of Dye 18.

Ink 21

This was prepared as Ink 19 but using 0.075 parts of Dye 5 and 0.075 parts of Dye 13.

TRANSFER SHEET TS1

This was prepared by applying Ink 1 to a 6 μm polyethylene terephthalate sheet (substrate) using a wire-wound metal Meyer bar (K-bar No.3) to produce a wet film of ink on the surface of the sheet. The ink was dried with hot air to give a dry film on the surface of the substrate.

TRANSFER SHEETS TS2–TS18

These were prepared in the same manner as TS1 using each of Inks 2–18 in place of Ink 1.

PRINTED RECEIVER SHEET RS1

A sample of TS1 was contacted with a receiver sheet, comprising a composite structure based in a white polyester base having a receptive coating layer on the side in contact with the printed surface of TS1. The receiver and transfer sheets were placed together on the drum of a transfer printing machine and passed over a matrix of closely-spaced pixels which were selectively heated in accordance with a pattern information signal to a temperature of 300° C. for periods from 2 to 10 msec, whereby a quantity of the dye, in proportion to the heating period, at the position on the transfer sheet in contact with a pixel while it was hot was transferred from the transfer sheet to the receiver sheet. After passage over the array of pixels the transfer sheet was separated from the receiver sheet.

PRINTED RECEIVER SHEETS RS2 to RS18

These were prepared in the same way as RS1 using TS2 to TS18 in place of TS1.

EVALUATION OF INKS, TRANSFER SHEETS AND PRINTED RECEIVER SHEETS

The stability of the ink and the quality of the print on the transfer sheet was assessed by visual inspection. An ink was considered stable if there was no precipitation over a period of two weeks at ambient and a transfer sheet was considered stable if it remained substantially free from crystallisation for a similar period.

The quality of the printed impression on the receiver sheet was assessed in respect of reflected optical density (OD), of colour measured with a Sakura digital densitometer. The grease resistance (GNT 2) of the print was assessed by measuring the reflected OD as above after rubbing with a pad soaked in lard oil for a set period and incubation at 55° C. and 60% relative humidity for 24 hours. The GNT 2 values are expressed as a % change in OD where the smaller the negative value the better is the performance of the dye or dye mixture.

The results of these evaluations are shown in Table 3.

TABLE 3

| Receiver Sheet | OD | GNT 2 (% change in OD) |
|---|---|---|
| 1 | 0.99* | — |
| 2 | 1.23 | −2.6 |
| 3 | 1.56 | −8.3 |
| 4 | 1.19* | — |
| 5 | 1.51 | −6.8 |
| 6 | 1.52 | −1.8 |
| 7 | 1.30 | −4.0 |
| 8 | 0.75* | — |
| 9 | 0.48* | — |
| 10 | 1.43 | −3.1 |
| 11 | 1.61 | −6.8 |
| 12 | 2.45 | −5.7 |
| 13 | 2.34 | −13.7 |
| 14 | 1.70* | −10.7 |
| 15 | 2.17 | −8.8 |
| 16 | 0.55* (1.27+) | — |
| 17 | 0.51* | — |
| 18 | 2.60 | −15.2 |
| 19 | 2.26 | −6.4 |
| 20 | 2.21 | −8.0 |
| 21 | 1.96 | −7.2 |

*OD results low because of low solubility of the dye in THF which means that there was less dye in the ink and therefore on the transfer sheet.
+OD result obtained using Dye 16 (0.1 parts) and EHEC (0.26 parts) in chloroform (14.5 parts).

We claim:

1. A thermal transfer printing sheet comprising:

a substrate having a coating comprising a binder and an anthraquinone dye of Formula I:

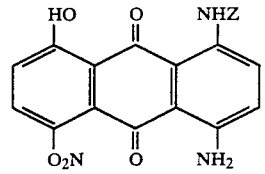

I wherein Z is hydrogen or an optionally substituted alkyl radical, optionally substituted cycloalkyl radical or an optionally substituted aryl radical.

2. A thermal transfer printing sheet according to claim 1 wherein Z, in the anthraquinone dye is selected from $C_{1-8}$-alkyl optionally substituted by $C_{1-4}$-alkoxy-, phenyl-, $C_{1-4}$-alkylcarbonyloxy-, cyano-, or $C_{1-4}$-alkoxycarbonyl-;

phenyl optionally substituted by halogen-, $C_{1-4}$-alkyl-, $C_{1-4}$-alkylcarbonylamino-, $C_{1-4}$-alkylcarboxy-, $C_{1-4}$-alkoxy-, N-($C_{1-4}$-alkyl)amino- or N,N-di($C_{1-4}$-alkyl)amino-; and $C_{4-8}$-cycloalkyl optionally substituted by $C_{1-4}$-alkyl-, phenyl-$C_{1-4}$-alkyl- or $C_{1-4}$-alkoxy-.

3. A thermal transfer printing sheet according to claim 1 wherein Z, in the anthraquinone dye is $C_{1-4}$-alkyl optionally substituted by $C_{1-4}$-alkoxy-, $C_{1-4}$-alkylcarbonyloxy-, cyano-, $C_{1-4}$-alkoxycarbonyl- or phenyl-.

4. A thermal transfer printing sheet according to claim 1 wherein Z, in the anthraquinone dye is selected from phenyl, 4-chlorophenyl, 2-methylphenyl, 3-methylphenyl, 4-methylphenyl, acetylaminophenyl, cyclohexyl, ethylphenyl, methoxyphenyl, methoxypropyl, n-propoxypropyl, benzyl, methyl, n-propyl, isobutyl and sec-butyl.

5. A thermal transfer printing sheet comprising a substrate having a coating comprising a mixture of an anthraquinone according to claim 1 and a disazo dye of Formula II:

$$A-N=N-B-N=N-E \qquad \text{II}$$

wherein:

A is the residue of a diazotisable phenylamine or naphthylamine, A-$NH_2$, carrying not more than one unsaturated electron-withdrawing group;

B is an optionally substituted thiophen-2,5-ylene or thiazol-2,5-ylene group; and E is the residue of an aromatic coupling component E-X wherein X is an atom or group displaceable by a diazotised aromatic amine.

6. A thermal transfer printing sheet according to claim 5 wherein A, in the disazo dye, is of the Formula V:

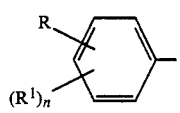

V wherein:

R is selected from —H; —CN; —SCN; —$NO_2$; —$CONT_2$; —$SO_2NT_2$; —$COT^1$; —$SO_2T^1$; —$COOT^2$; —$SO_2T^2$; —COF; —COCl; —$SO_2F$; —$SO_2Cl$ wherein each T is independently —H, $C_{1-4}$-alkyl or phenyl; $T^1$ is $C_{1-4}$-alkyl or phenyl; $T^2$ is $C_{1-4}$-alkyl;

each $R^1$ is independently selected from —H; $C_{1-4}$-alkyl; $C_{1-4}$-alkoxy; —F; —Cl; —Br; —$CF_3$ and —$NT_2$ wherein each T is independently —H, $C_{1-4}$-alkyl or phenyl; and n is 1, 2 or 3.

7. A thermal transfer printing sheet according to claim 5 wherein B, in the disazo dye, is of the Formula VI:

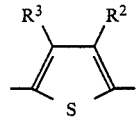

VI wherein:

$R^2$ is selected from —CN; —$NO_2$; —$CONT_2$; —$SO_2NT_2$; —$COT^1$; —$SO_2T^1$; H, $C_{1-4}$-alkyl; $C_{1-4}$-alkoxy; phenyl, nitrophenyl; $C_{1-4}$-alkoxycarbonyl; $C_{1-4}$-alkoxy-$C_{1-4}$-alkoxycarbonyl; and halogen wherein T is independently —H; $C_{1-4}$-alkyl or phenyl; $T^1$ is $C_{1-4}$-alkyl or phenyl; and $R^3$ is selected from —H; $C_{1-4}$-alkyl; $C_{1-4}$-alkoxy; phenyl; nitrophenyl; $C_{1-4}$-alkoxycarbonyl; $C_{1-4}$-alkoxy-$C_{1-4}$-alkoxycarbonyl and halogen.

8. A thermal transfer printing sheet according to claim 5 wherein E, in the disazo dye, is of the Formula VII:

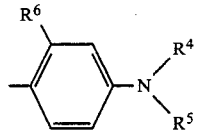

VII wherein:

$R^4$ and $R^5$ are independently selected from —H; $C_{1-4}$-alkyl; phenyl; $C_{4-8}$-cycloalkyl; $C_{1-4}$-alkyl substituted by a group selected from —OH, —CN, halogen, phenyl, $C_{1-4}$-alkoxy, $C_{1-4}$-alkoxy-$C_{1-4}$-alkoxy, $C_{1-4}$-alkylcarbonyl, $C_{1-4}$-alkoxycarbonyl, $C_{1-4}$-alkylcarbonyloxy, $C_{1-4}$-alkoxy-$C_{1-4}$-alkoxycarbonyl, $C_{1-4}$-alkoxycarbonyloxy and phenyl optionally carrying a substituent selected from R and $R^1$ in claim 6;

$R^6$ is selected from —H; $C_{1-4}$-alkyl; cyano $C_{1-4}$-alkyl; $C_{1-4}$-alkoxy and —$NHCOT^1$ wherein $T^1$ is $C_{1-4}$-alkyl or phenyl.

9. A thermal transfer printing sheet according to claim 5 wherein the disazo dye is of the Formula VIII:

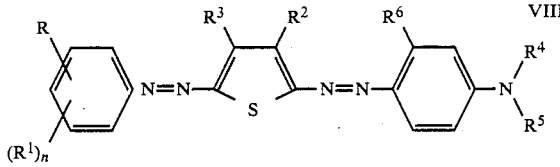

VIII wherein:

R is selected from H; —CN; —$NO_2$; —$CONT_2$—; —$SO_2NT_2$; —COT; —$SO_2T^1$; $COOT^2$ and $SO_2OT^2$;

each $R^1$ is independently selected from H; halogen; $CF_3$; $C_{1-4}$-alkyl; $C_{1-4}$-alkoxy; —$NT_2$;

n is 1, 2 or 3;

$R^2$ is selected from CN, —$COT^1$; —$CONT_2$ and $COOT^1$;

$R^3$ is H or $C_{1-4}$-alkyl;

$R^4$ and $R^5$ are independently selected from H, $C_{1-4}$-alkyl, phenyl, $C_{4-8}$-cycloalkyl and $C_{1-4}$-alkyl substituted by a group selected from OH, CN, $C_{1-4}$-alkoxy, $C_{1-4}$-alkoxy-$C_{1-4}$-alkoxy, $C_{1-4}$-alkyl-CO—, $C_{1-4}$-alkoxy-CO—, $C_{1-4}$-alkyl-COO—, halogen, $C_{1-4}$-alkoxy-$C_{1-4}$-alkoxy-CO—, $C_{1-4}$-alkoxy-COO— and phenyl; and $R^6$ is selected from H, $C_{1-4}$-alkyl, cyano $C_{1-4}$-alkyl, $C_{1-4}$-alkoxy and —NHCOT[1]

wherein each T is independently —H, $C_{1-4}$-alkyl or phenyl, $T^1$ is $C_{1-4}$-alkyl or phenyl, $T^2$ is $C_{1-4}$-alkyl.

10. A thermal transfer printing sheet according to claim 9 wherein in the disazo dye of Formula VIII:

R is selected from —H; —CN; $C_{1-4}$-alkyl-$SO_2$— and $C_{1-4}$-alkoxycarbonyl;

$R^1$ is selected from —H; —Cl; —Br; —$CF_3$; $C_{1-4}$-alkyl;

$R^2$ is —CN or —$CON(CH_3)_2$;

$R^3$ is —H; $CH_3$ or $C_{1-4}$-alkyl-CONH—;

$R^4$ is ethyl;

$R^5$ is ethyl or ethoxyethyl; and n is 1.

11. A thermal transfer printing sheet according to claim 5 wherein the disazo dye is of the Formula IX:

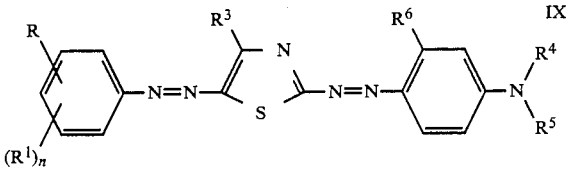

wherein:

R is selected from H; —CN; —$CONT_2$; —$SO_2NT_2$; —COT; —$SO_2T^1$; $COOT^2$ and $SO_2OT^2$;

each $R^1$ is selected from H; halogen; $CF_3$; $C_{1-4}$-alkyl; $C_{1-4}$-alkoxy; $NT_2$;

n is 1, 2 or 3;

$R^3$ is H or $C_{1-4}$-alkyl;

$R^4$ and $R^5$ are independently selected from H, $C_{1-4}$-alkyl, phenyl, $C_{4-8}$-cycloalkyl and $C_{1-4}$-alkyl substituted by a group selected from OH, CN, $C_{1-4}$-alkoxy, $C_{1-4}$-alkoxy-$C_{1-4}$-alkoxy, $C_{1-4}$-alkyl-CO—, $C_{1-4}$-alkoxy-CO—, $C_{1-4}$-alkyl-COO—, halogen, $C_{1-4}$-alkoxy-$C_{1-4}$-alkoxy-CO—, $C_{1-4}$-alkoxy-COO— and phenyl; and $R^6$ is selected from H, $C_{1-4}$-alkyl, cyano $C_{1-4}$-alkyl, $C_{1-4}$-alkoxy and —NHCOT[1]

wherein each T is independently —H, $C_{1-4}$-alkyl or phenyl, $T^1$ is $C_{1-4}$-alkyl or phenyl, $T^2$ is $C_{1-4}$-alkyl.

12. A thermal transfer printing sheet according to claim 11 wherein in the disazo dye of Formula IX:

R and $R^1$ are —H;

$R^3$ is —H or —$CH_3$;

$R^4$ and $R^5$ are selected from ethyl, n-propyl or n-butyl;

$R^6$ is —H, —$CH_3$ or acetylamino; and n is 1.

13. A thermal transfer printing sheet according to claim 5 wherein Z, in the anthraquinone dye, is sec-butyl or 4-methylphenyl and in the disazo dye R, $R^1$ and $R^3$ are hydrogen; $R^2$ is cyano; $R^4$ is ethyl; $R^5$ is ethyl or ethoxyethyl; and $R^6$ is acetylamino or hydrogen.

14. A transfer printing process which comprises contacting a transfer sheet according to claim 5 with a receiver sheet, so that the dye is in contact with the receiver sheet and selectively heating areas of the transfer sheet whereby dye in the heated areas of the transfer sheet may be transferred to the receiver sheet.

15. A transfer printing process according to claim 14 wherein the receiver sheet is white polyester film.

16. A transfer printing process which comprises contacting a transfer sheet according to claim 1 with a receiver sheet, so that the dye is in contact with the receiver sheet and selectively heating areas of the transfer sheet whereby dye in the heated areas of the transfer sheet may be transferred to the receiver sheet.

17. A transfer printing process according to claim 16 wherein the transfer sheet is heated to a temperature from 300° C. to 400° C. for a period of 1 to 20 milliseconds while in contact with the receiver sheet whereby the amount of dye transferred is proportional to the heating period.

18. A transfer printing process according to claim 17 wherein the receiver sheet is white polyester film.

19. A transfer printing process according to claim 16 wherein the receiver sheet is white polyester film.

* * * * *